US005094557A

United States Patent [19]

Nelson et al.

[11] Patent Number: 5,094,557

[45] Date of Patent: Mar. 10, 1992

[54] GOLF CLUB RENOVATING DEVICE

[76] Inventors: Peter K. Nelson, 5752 E. Bannock; Christopher F. Nelson, 2766 E. Rockledge, both of, Phoenix, Ariz. 85044

[21] Appl. No.: 448,080

[22] Filed: Dec. 8, 1989

[51] Int. Cl.[5] ..... A46B 11/00; A46B 15/00

[52] U.S. Cl. ..... 401/11; 401/268; 15/104.04

[58] Field of Search ..... 273/32 R, 32 A; 15/107, 15/210 B, 104.92, 104.04; 401/11, 9, 10, 268

[56] References Cited

U.S. PATENT DOCUMENTS

| | | | |
|---|---|---|---|
| 1,714,346 | 5/1929 | Carleton | 15/210 B |
| 1,758,011 | 5/1930 | Reach . | |
| 1,918,529 | 7/1933 | Frater . | |
| 2,807,037 | 9/1957 | Garske | 15/21 |
| 3,224,029 | 12/1965 | Domingos | 15/104.92 |
| 4,069,536 | 1/1978 | Hartz | 15/104.92 |
| 4,380,839 | 4/1983 | Caradonna | 15/104.92 |
| 4,439,884 | 4/1984 | Giorni | 15/104.92 |
| 4,676,839 | 6/1987 | Osborn | 15/104.04 |
| 4,734,952 | 4/1988 | Parchment | 15/104.92 |
| 4,923,316 | 5/1990 | Fattal | 401/138 |
| 4,934,066 | 6/1990 | Rose | 34/9 |
| 4,953,999 | 9/1990 | Rivers | 401/11 |

*Primary Examiner*—Danton D. DeMille
*Attorney, Agent, or Firm*—Cahill, Sutton & Thomas

[57] ABSTRACT

A golf club handle renovating device for cleaning and for removing an outer, weather-hardened rubber surface of a golf club handle to expose an underlying supply rubber surface includes a tube containing a plurality of stiff plastic blades attached at one end to the inner surface of the tube. The blades project inwardly from the inner surface of the tube so that a second end of the blades define a longitudinal central void adapted to closely receive the handle therein.

2 Claims, 2 Drawing Sheets

GOLF CLUB RENOVATING DEVICE

The invention relates to a device for cleaning and debriding golf club handles.

Golf club handles are usually made of rubber or rubber-like materials. In a new handle the rubber is supple and easy to grip. However, when a rubber handle is exposed to a hot, dry and sunny climate such as that typical in the southwestern United States, the top surface of the handle loses suppleness and becomes hard. A golfer using a club having such a handle will have difficulty gripping it properly. Consequently, his swing will be off and his golf game will suffer.

One solution to the problem of a weather-hardened club handle is to replace the handle. Alternatively, the entire club can be replaced. At present there does not appear to be a devioe for cleaning or renovating golf club handles. However, there are several devices for cleaning golf balls. For example, U.S. Pat. No. 1,758,011 to Reach discloses a golf ball washer consisting of a cylinder having inwardly projecting brushes and a rod for holding a golf ball and moving the ball inside the cylindrical brush. U.S. Pat. No. 1,918,920 to Frater describes a golf ball washer comprising two brushes facing each other in a compartment; a spring urges the brushes together while the golf ball to be cleaned is placed inside a handle and moved between the two brushes. U.S. Pat. No. 2,807,037 to Garske describes a device similar to that disclosed in the patent to Frater.

The golf ball cleaning devices discussed above scrub dirt from all portions of a golf ball, including the indentations therein. None of the devices remove or debride the top surface of the golf balls; it is doubtful that the brushes used in such devices have bristles strong enough to debride a golf ball. In fact, debridement of a golf ball is to be avoided, because such debridement would likely deleteriously affect the ball surface and thus the aerodynamics of the golf ball. The use of such devices on a golf club handle would be illogical and of little effect on the handle.

SUMMARY OF THE INVENTION

Briefly described, and in accordance with one embodiment of the invention, the invention provides a golf club handle cleaning and renovating device for removing an outer, weather-hardened rubber surface of a golf club handle to expose an underlying supple rubber surface. The device includes a tube containing stiff plastic blades attached at one end to the inner surface of the tube so that the blades project inwardly from the inner surface. A second end of the blades define a longitudinal central void adapted to closely receive the handle therein.

It is an object of the present invention to provide a device for cleaning and debriding golf club handles.

It is another object of the present invention to provide an inexpensive device for renovating golf club handles.

It is another object of the present invention to provide a simple and rapid method for renovating golf club handles.

Other objects, advantages and features of the present invention will become apparent from the following specification when taken in conjunction with the accompanying drawings.

DETAILED DESCRIPTION OF THE PREFERRED EMBODIMENTS

Figure 1A:
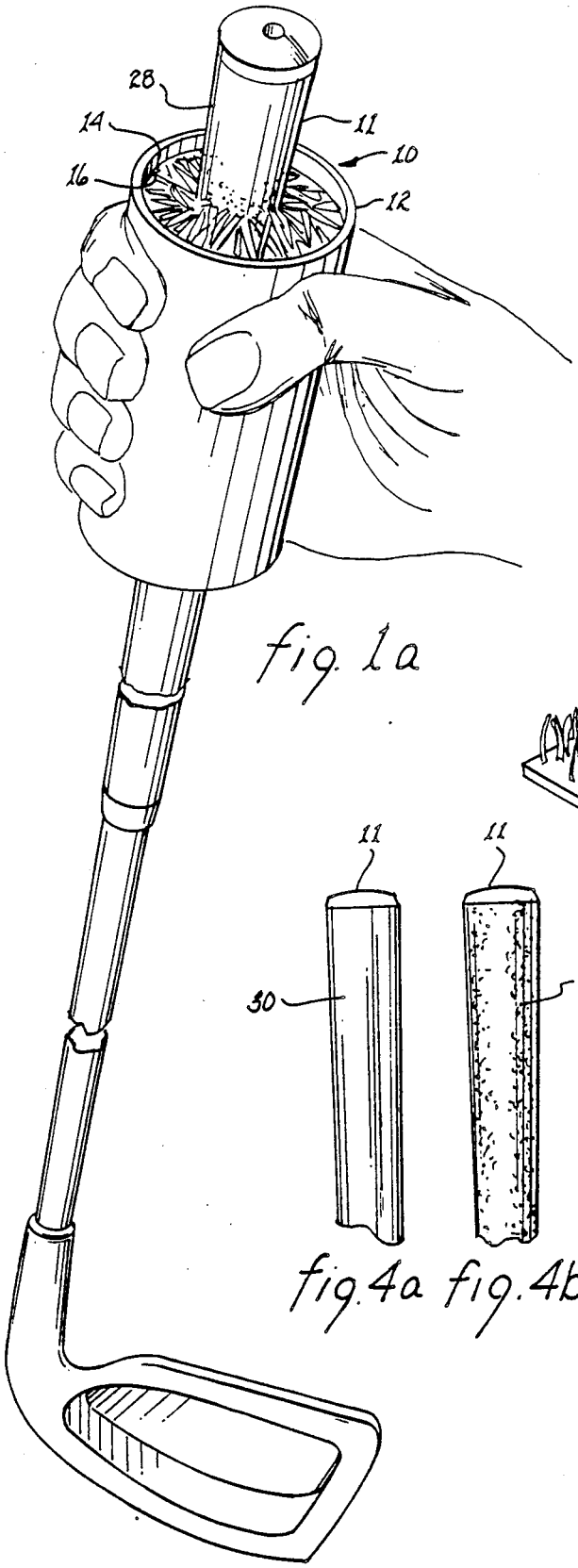
FIG. 1*a* is a perspective view of one embodiment of the golf club renovation device of the present invention shown in use on a golf club handle.
Figure 2:
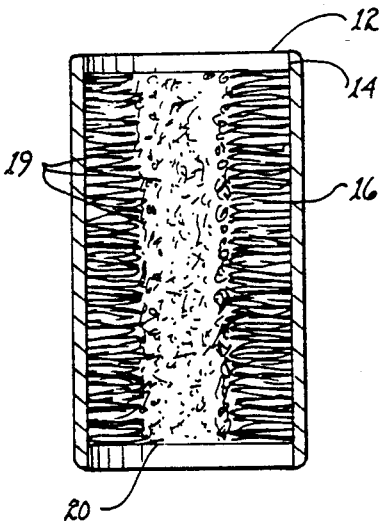
FIG. 2 is a sectional view of a portion of FIG. 1*a* showing the interior of the renovating device of the present invention.
Figure 3:
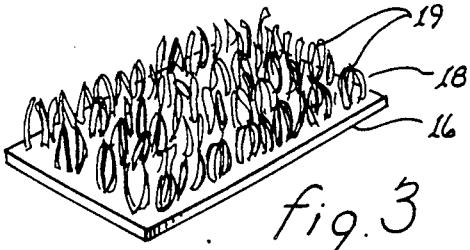
FIG. 3 is a perspective view of the mat of blades used in the golf club renovating device of the present invention.

FIG 1*a* shows a person using a golf club handle renovating device 10 of the present invention to renovate club handle 11. In this embodiment, renovating device 10 comprises a tube 12 made from a hard but resilient plastic such as polystyrene or polyvinyl chloride. Glued to the inside wall 14 of tube 12 is a mat 16 containing relatively rigid blades 18 of a flexible but stiff material such as polyethylene, shown in detail in FIG. 3. A suitable commercially available material is known as "Astro Turf". As illustrated in FIG. 2, blades 18 project inwardly from inside surface 14. Blade tips 19 define a cylindrical central void 20 sufficient to accommodate handle 11 therein.

Figure 1B:
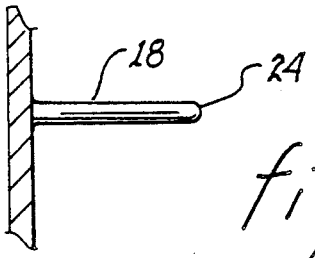
FIG. 1*b* is a closeup view of one embodiment of the blades used in the golf club renovating device of the present invention.
Figure 1C:
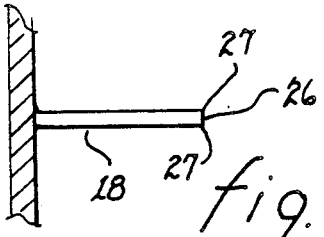
FIG. 1*c* is a closeup view of another embodiment of the blades used in the golf club renovating device of the present invention.

FIGS. 1*b* and 1*c* illustrate two different embodiments of blade tips 19. In FIG. 1*b*, blade tips 19 have an arcuate shape 24. In FIG 1*c*, blade tips 19 have a square shape 26. Square shape 26 is preferred because sharp points 27 of the square shape debride the rough hard rubber surface of handle 11 better than rounded arcuate shape 24.

Figures 4A, 4B:
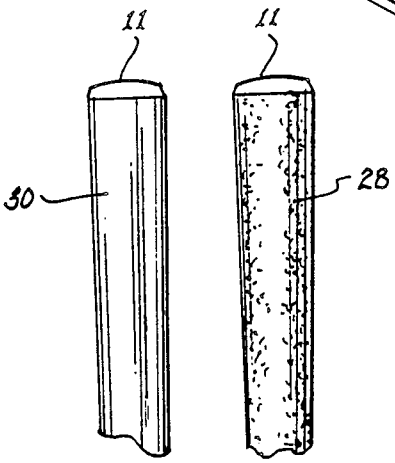
FIG. 4*a* is a perspective view of the smooth surface of a golf club handle.
FIG. 4*b* is a perspective view of the hard surface of a golf club handle.
Figure 5:
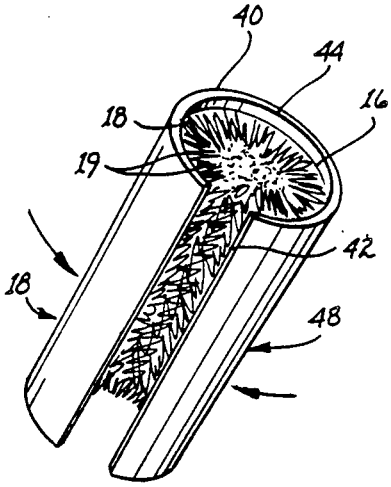
FIG. 5 is a second embodiment of the golf club renovating device of the present invention.

To renovate handle 11, the handle is inserted in central void 20 of renovating device 10. Blade tips 19 closely contact the dirty weather-hardened rubber outer surface 28 of handle 11. Hard rubber outer surface 28 is shown in more detail in FIG. 4*b*. To remove or debride hard rubber outer surface 28, renovating device 10 is repeatedly passed over the entire length of handle 11, and may also be rotated to provide a scrubbing action. The stiff blade tips 19 are strong enough to remove dirt and also scrape or debride hard rubber surface 28 from handle 11, thus exposing the clean soft supple rubber surface 30, illustrated in FIG. 4*a* , which underlies hard rubber surface 28 Movement of device 10 over handle 11 can be accomplished either manually, or by attaching the device to an electric motor. FIG. 5 illustrates a second embodiment of the invention in which tube 12 of FIG. 1*a* has been replaced by a resilient plastic tube 40 having a longitudinal split 42 defined by edges 46. Split 42 is sufficiently wide to accommodate all sizes of handles inside tube 40. As in the embodiment illustrated in FIG. 1*a*, glued to the inside wall 44 of tube 40 is a mat 16 containing relatively rigid blades 18. Blades 18 and blade tips 19 are the same as those described above. Blade tips 19 define a void 44 aligned with longitudinal split 42.

To use the embodiment illustrated in FIG. 5, club handle 11 is inserted in void 44. If handle 11 has a larger diameter than average, edges 46 spread apart to accommodate the larger handle. After handle 11 is in place inside void 44, edges 46 of tube 40 are squeezed together by manual pressure in the directions illustrated by arrows 48, thereby forcing blade tips 19 into close contact with hard rubber outer surface 28 of handle 11. Tube 40 is then repeatedly passed over the entire length of handle 11 and may also be rotated to provide a scrubbing action, thereby removing hard rubber surface 28 to expose soft supple rubber surface 30. As with the embodiment described in FIG. 1*a*, movement of tube 40 over handle 11 can be accomplished either manually, or by attaching the tube to an electric motor.

Figure 6:
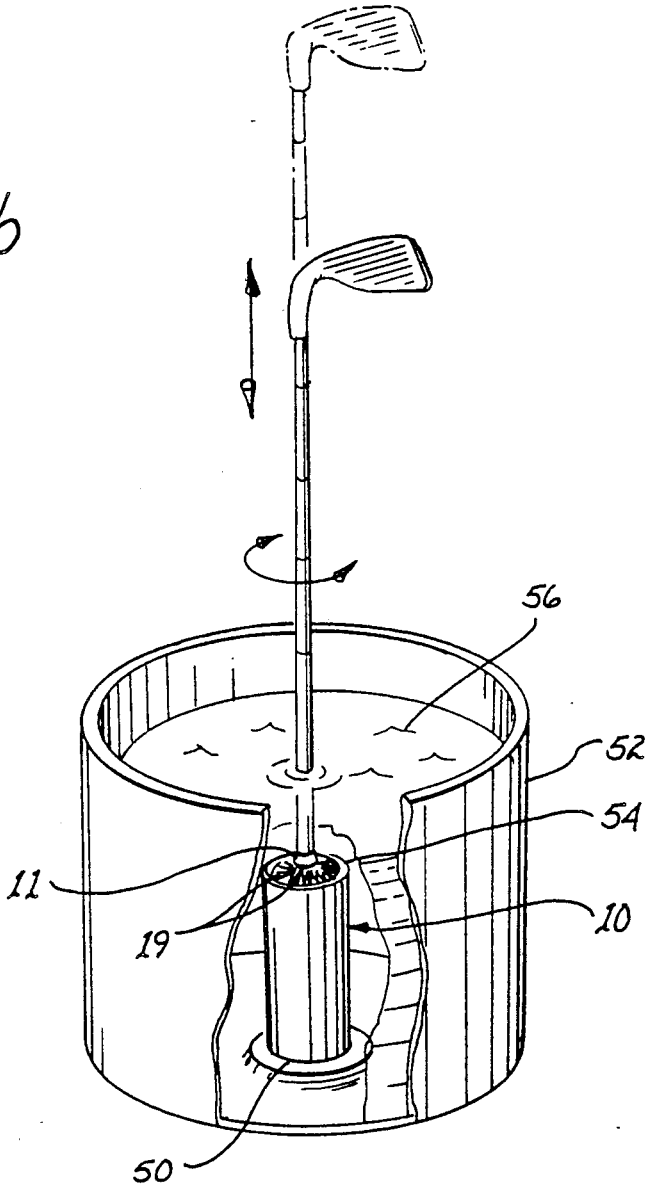
FIG. 6 is a third embodiment of the golf club renovating device of the present invention.

FIG. 6 illustrates a third embodiment of the invention in which first end 50 of the renovating device 10 of FIG. 1*a* has been secured to the bottom of vessel 52. To renovate handle 11, it is inserted into second end 54 of renovating device 10; the handle is then repeatedly moved up and down and also rotated so that stiff blades tips 19 scrub against the handle, thereby removing hard rubber surface 28 to expose soft supple rubber surface 30. A liquid 56 such as water or a detergent solution can be added to vessel 52 to facilitate the cleaning and renovating of handle 11.

It is to be understood that the present invention is not limited to the particular construction and arrangement of parts disclosed and illustrated herein, but embraces all such modified forms thereof which are within the scope of the following claims.

We claim:

1. A method for cleaning and renovating a golf club handle by removing a weather-hardened, outer rubber surface of the handle to expose an underlying supplied rubber surface, the method comprising the steps of:

a. providing a resilient plastic tube;

b. gluing a mat comprised of a plurality of stiff plastic blades attached thereto to the inner surface of the tube so that the blades project inwardly from the inner surface, the free ends of the blades thus defining a longitudinally extending central void adapted to receive the handle therein;

attaching a first end of the tube to the bottom of a vessel;

d. filling the vessel with cleansing liquid to submerge the tube, to facilitate renovating of the handle;

e. inserting the golf club handle into the central void; and f. moving the free ends of the blades across the entire outer handle surface so that the free ends of the blades remove the outer handle surface, thus exposing the underlying supple rubber surface.

2. A golf club handle renovating device for cleaning and for removing a weather-hardened, outer rubber surface of a golf club handle to expose an underlying supplied rubber surface, the device comprising:

a. a tube made from a resilient plastic selected from the group consisting of polystyrene and polyvinyl chloride; and a mat glued to the inner surface of the tube;

b. stiff plastic blades, a first end of each blade being attached to the inner surface of the mat, the blades projecting inwardly from the inner surface of the tube so that a second end of the blades define a longitudinally extending central void adapted to closely receive the handle therein, the second ends of the blades thus engaging the outer, hardened handle surface, and wherein the blades are made from polyethylene; and c. a vessel, wherein a first end of the tube is secured to the bottom of the vessel.

* * * * *